US008419100B2

(12) United States Patent
Chinn

(10) Patent No.: US 8,419,100 B2
(45) Date of Patent: Apr. 16, 2013

(54) BRACKET FOR ENGAGING AN EMERGENCY COT WITHIN AN EMERGENCY VEHICLE

(75) Inventor: Bob Chinn, Cumming, GA (US)

(73) Assignee: Ferno-Washington, Inc., Wilmingotn, OH (US)

( * ) Notice: Subject to any disclaimer, the term of this patent is extended or adjusted under 35 U.S.C. 154(b) by 515 days.

(21) Appl. No.: 12/377,484

(22) PCT Filed: Aug. 15, 2007

(86) PCT No.: PCT/US2007/075969

§ 371 (c)(1),
(2), (4) Date: Aug. 18, 2010

(87) PCT Pub. No.: WO2008/022174

PCT Pub. Date: Feb. 21, 2008

(65) Prior Publication Data

US 2010/0301083 A1 Dec. 2, 2010

Related U.S. Application Data

(60) Provisional application No. 60/837,952, filed on Aug. 15, 2006.

(51) Int. Cl.
*A61G 1/02* (2006.01)

(52) U.S. Cl.
USPC ..... 296/20

(58) Field of Classification Search ..... 296/20, 296/65.04; 410/3, 4, 7, 80
See application file for complete search history.

(56) References Cited

U.S. PATENT DOCUMENTS

| | | | | |
|---|---|---|---|---|
| 2,303,618 | A | 12/1942 | Couleur | |
| 3,918,554 | A * | 11/1975 | Bourgraf et al. | 188/32 |
| 7,549,690 | B2 * | 6/2009 | Bourgraf et al. | 296/20 |
| 2006/0131909 | A1 * | 6/2006 | Bourgraf et al. | 296/20 |

FOREIGN PATENT DOCUMENTS

| | | | |
|---|---|---|---|
| EP | 1378220 | A1 | 1/2004 |
| FR | 2895710 | A1 | 7/2007 |
| JP | 037418 | A | 2/2000 |

OTHER PUBLICATIONS

Japanese Office Action date Feb. 23, 2012 pertaining to co-pending Japanese Patent Application No. 2009-524778 filed Aug. 15, 2007.
International Search Report and Written Opinion of the EPO as ISA as it relates to PCT/US2007/075969 mailed Dec. 28, 2007.
Examination Report dated Apr. 19, 2012 related to Australian patent application Ser. No. 2007285907.
European Patent Office Examination Report pertaining to application No. EP 07814105.8, dated Sep. 22, 2010.
State Intellectual Property Office of the People'Republic of China First Office Action mailed May 10, 2010 in reference to co-pending Chinese Pat. Appln. No. 200780036313.0 filed Aug. 15, 2007.

* cited by examiner

*Primary Examiner* — Lori Lyjak
(74) *Attorney, Agent, or Firm* — Dinsmore & Shohl LLP

(57) ABSTRACT

A collapsible bracket for an emergency vehicle that includes a base for mounting to an emergency vehicle and a framework connected to the base. The framework is movable between a contracted position and an expanded position such that the framework engages an emergency cot within an emergency vehicle when in the expanded position and does not engage an emergency cot within an emergency vehicle when in the contracted position.

17 Claims, 3 Drawing Sheets

BRACKET FOR ENGAGING AN EMERGENCY COT WITHIN AN EMERGENCY VEHICLE

The present invention relates generally to a bracket for engaging an emergency cot. More particularly, the present invention relates to a collapsible bracket for engaging and/or holding an emergency cot substantially stationary within an emergency vehicle.

Emergency vehicles and emergency cots that are placed into the emergency vehicles are well known in the art. There are a wide variety of emergency vehicles and emergency cots commercially available. These emergency vehicles and emergency cots are used in both the private and military sectors.

The present invention is directed to a bracket for engaging and/or securing an emergency cot within an emergency vehicle.

One embodiment of the present invention is a bracket for an emergency vehicle that includes a base for mounting to an emergency vehicle and a framework connected to the base. The framework is movable between a contracted position and an expanded position, wherein the framework engages an emergency cot within an emergency vehicle when in the expanded position.

Another embodiment of the present invention is a bracket for an emergency vehicle that includes a base for mounting to an emergency vehicle and a first engagement device movably connected to the base. The first engagement device is movable between a first position wherein the first engagement device does not engage an emergency cot within an emergency vehicle and a second position wherein the first engagement device engages an emergency cot within in an emergency vehicle.

Yet another embodiment of the present invention is a bracket for an emergency vehicle that includes a base for mounting to an emergency vehicle, a first arm connected to the base, and a second arm connected to the base opposite the first arm. The first and second arms are movable between a first position and a second position. The first position disposes first and second arms such that the arms do not engage an emergency cot within an emergency vehicle. The second position disposes first and second arms such that the arms engage an emergency cot within the emergency vehicle.

While the specification concludes with claims particularly pointing out and distinctly claiming the invention, it is believed the same will be better understood from the following description taken in conjunction with the accompanying drawings in which:

Figure 1:
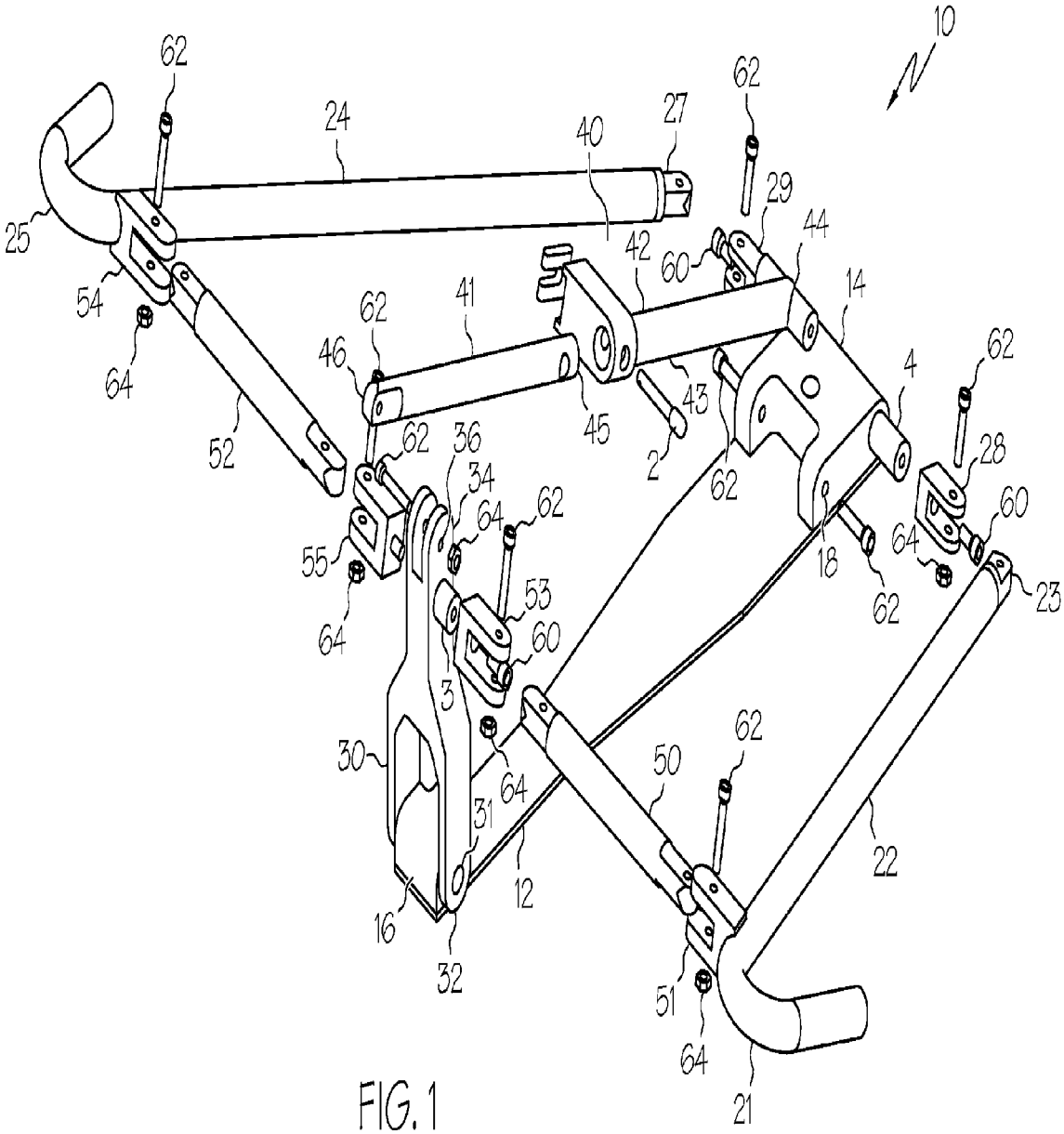
FIG. 1 is an exploded perspective view of an exemplary collapsible bracket according to an embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

Reference will now be made in detail to various embodiments of the invention, examples of which are illustrated in the accompanying drawings, wherein like numerals indicate similar elements throughout the views.

Referring to FIGS. 1-5, an exemplary embodiment of a collapsible bracket 10 for engaging an emergency cot within an emergency vehicle is illustrated. Collapsible bracket 10 may be used with a variety of emergency vehicles such as automotive ambulances, helicopters, airplanes, or any other emergency vehicles to engage and/or secure an emergency cot that is placed, loaded, or held within an emergency vehicle. For example, collapsible bracket 10 may engage an emergency cot such that it secures or holds the emergency cot in a substantially stationary position within the emergency vehicle. Collapsible bracket 10 may be permanently or removably attached to the emergency vehicle such as bolted or welded to an interior surface (e.g., a floor) within a back chamber of an automotive ambulance. Collapsible bracket 10 and all its components may be fabricated from a variety of conventional materials, including but not limited to plastics, metals (e.g., steel, stainless steel, aluminum, etc.), composites, or any combinations thereof. In one exemplary embodiment, collapsible bracket 10 is fabricated from steel.

Figure 3:
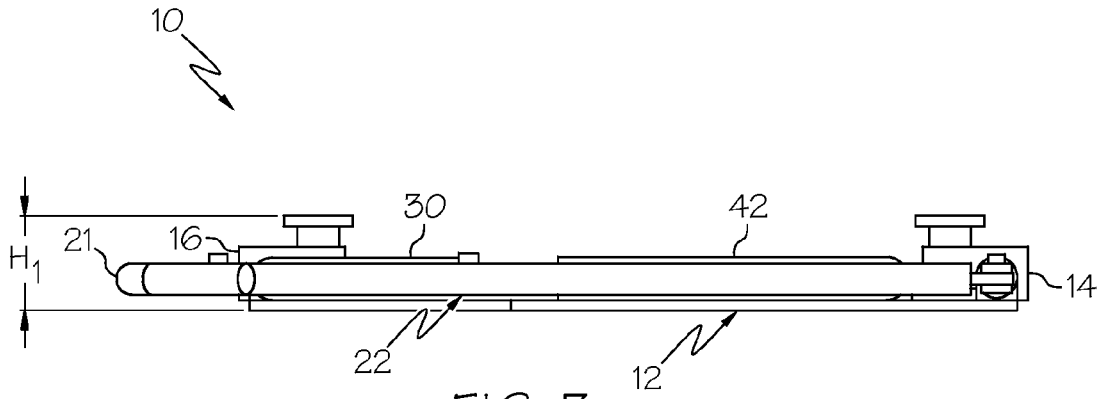
FIG. 3 is a side elevational view of the exemplary collapsible bracket illustrated in FIG. 2.
Figure 4:
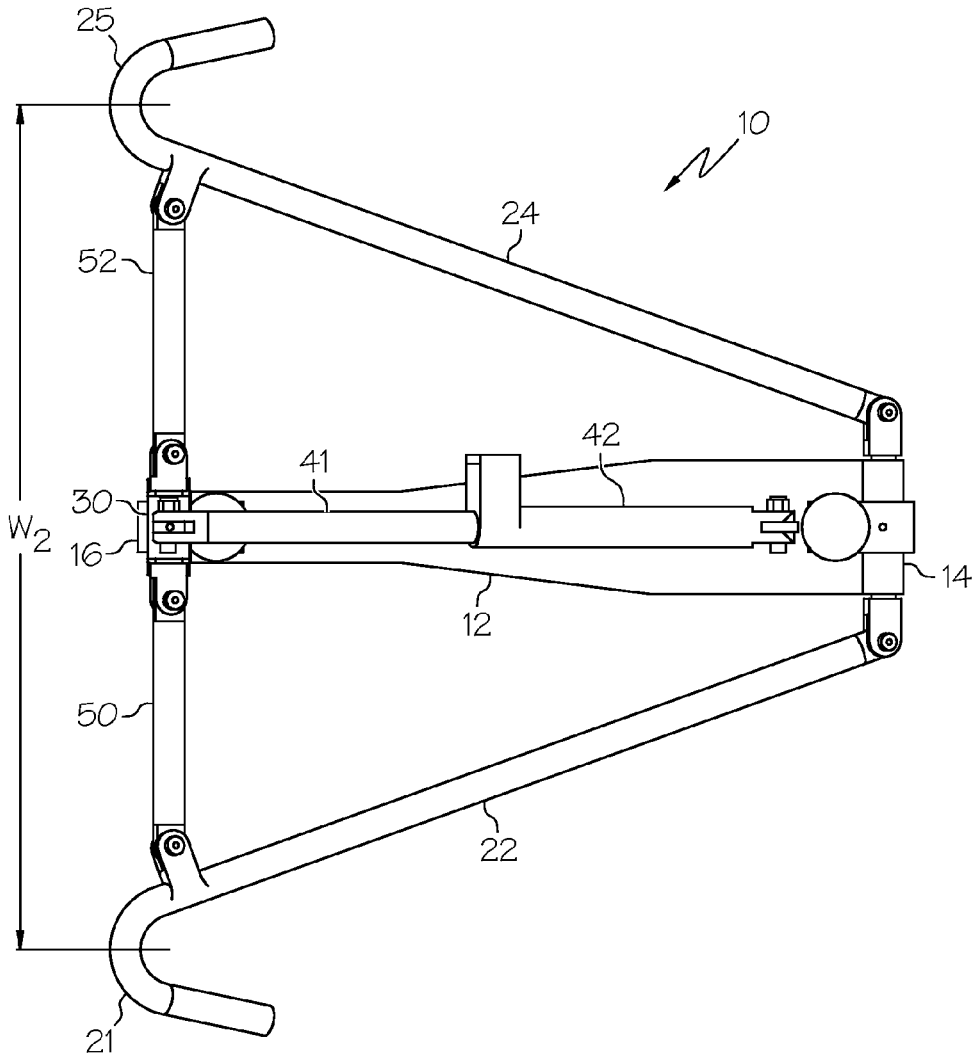
FIG. 4 is a top plan view of the exemplary collapsible bracket illustrated in FIG. 1 in an expanded position.
Figure 5:
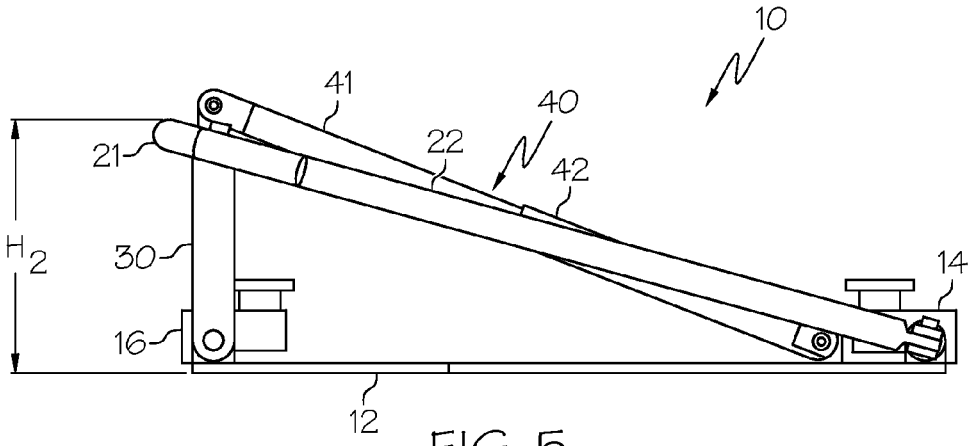
FIG. 5 is a side elevational view of the exemplary collapsible bracket illustrated in FIG. 4.

Collapsible bracket 10, in the exemplary embodiment shown, includes a base 12 that may be attached to the emergency vehicle such as welded to the floor of an interior chamber of the automotive ambulance. Base 12 may include a first base end 14 and a second base end 16 opposite first base end 14. Collapsible bracket 10 may also include a framework that is movably connected to base 12 such that it may move from a contracted (collapsed and/or folded) position (FIGS. 2 and 3) to an expanded (un-collapsed and/or un-folded) position (FIGS. 4 and 5). The framework may comprise any configuration or device that is designed to engage an emergency cot within an emergency vehicle when the framework is in the expanded position and not engage an emergency cot when the framework is in the contracted position In the exemplary embodiment shown, the framework includes a first arm 22 movably connected to first base end 14 using a first arm joint 28 and a second arm 24 movably connected to first base end 14 opposite first arm 22 using a second arm joint 29. First and second arm joints 28 and 29, in this exemplary embodiment, may be rotatably mounted to a pin 4 on first base end 14 using a cap screw 60. First and second arms 22 and 24 are movably mounted to respective first and second joints 28 and 29 using respective cap screws 62 and nuts 64. First and second arm joints 28 and 29, in this embodiment, are capable of rotation about two axes. However, it is understood that a single axis joint or a multiple axis joint (capable of rotation about two or more axes) may be used with the present invention.

First arm 22 and second arm 24 may include a first hook 21 and a second hook 25, respectively, positioned on an end of the first and second arms opposite first and second arm joints 28 and 29, respectively. First and second hooks 21 and 25 may be any device capable of engaging an emergency cot in order to hold, secure, and/or lock respective legs, wheels, wheel casters, or rollers of an emergency cot (e.g., rollers 102 of emergency cot 100, FIG. 6) in a substantially stationary position (prevent the emergency cot from moving) within an emergency vehicle.

The framework may also include a vertical support 30 having a first support end 32, a second support end 34, and pins 3 positioned at second support end 34. First support end 32 is movably connected to second base end 16 using a first support joint 31. The framework may also include a first linkage 50 connecting first arm 22 to vertical support 30 and a second linkage 52 positioned along vertical support 30 opposite first linkage 50 connecting second arm 24 to the vertical support as well. First linkage 50 is movably connected to first arm 22 near first hook 21 using a first linkage joint 51 that may include a cap screw 62 and a nut 64. First linkage 50 is also movably connected to vertical support 30 near second support end 34 using a second linkage joint 53, a cap screw 62, and a nut 64. Second linkage joint 53 may be movably connected to pin 3 using a cap screw 60. Second linkage 52 is movably connected to second arm 24 near second hook 25 using a third linkage joint 54, a cap screw 62, and a nut 64. Second linkage 52 is also movably connected to vertical support 30 near second support end 34 using a fourth linkage joint 55, a cap screw 62, and a nut 64.

In the exemplary embodiment shown, first and third linkage joints 51 and 54 are single axis joints such as a conventional hinge as known to one of ordinary skill in the art. Additionally, second and fourth linkage joints 53 and 55, in the exemplary embodiment, are joints that are rotatable about two axes as known to one of ordinary skill in the art. It is understood that other conventional joints may be used for the first, second, third, or fourth linkage joints as known to one of ordinary skill in the art, including but not limited to single, multiple (two or more axes of rotation), any other type of movable connection, or any combination thereof.

Figure 2:
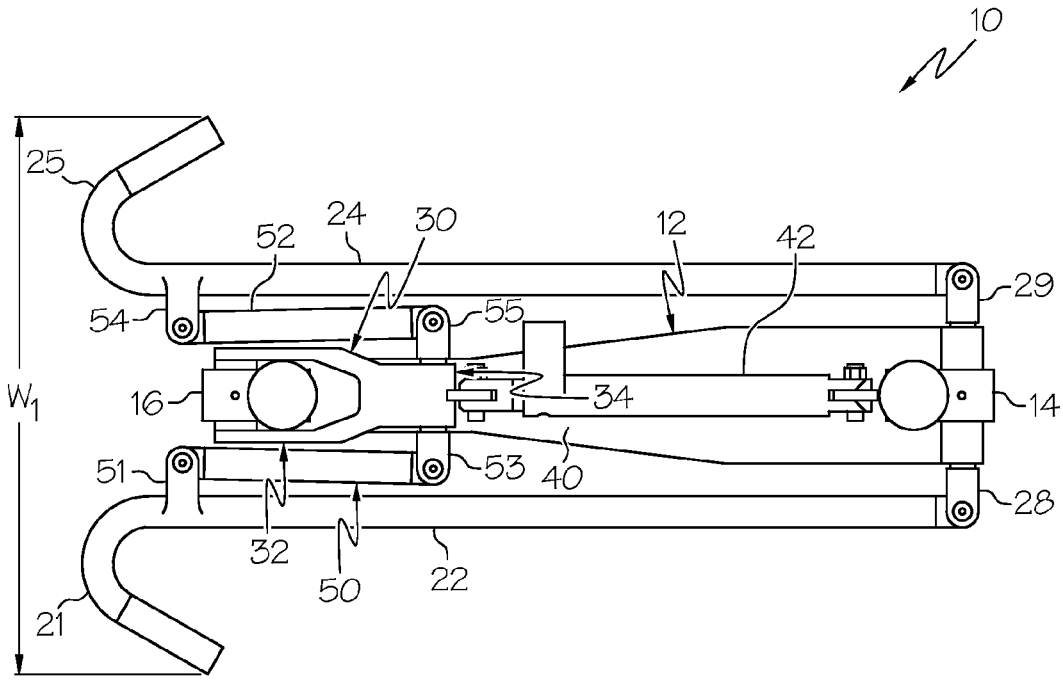
FIG. 2 is a top plan view of the exemplary collapsible bracket illustrated in FIG. 1 in a contracted position.

The framework in the exemplary embodiment may also include a latch bar 40 that is connected between first base end 14 and second support end 34. Latch bar 40 may be configured to expand and contract in length, i.e., expandable, depending upon the orientation of vertical support 30. In the exemplary embodiment shown, latch bar 40 includes an inner cylinder 41 and an outer cylinder 42. An inner cylinder end 46 of inner cylinder 41 may be movably connected to vertical support 30 at second support end 34 using a second support joint 36, cap screw 62, and a nut 64. Additionally, an outer cylinder end 44 of outer cylinder 42 may be movably connected to base 12 at first base end 14 using a first base joint 18 and two cap screws 62. When vertical support 30 is in a substantially horizontal orientation, inner cylinder 41 is substantially contained within outer cylinder 42 as shown in FIGS. 2 and 3. When vertical support 30 is moved to a substantially vertical position, the latch bar expands due to inner cylinder 41 sliding out of outer cylinder 42 such that inner cylinder 41 and outer cylinder 42 are substantially end-to-end (45-to-43, respectively) as shown in FIGS. 1, 4 and 5. The latch bar may also include a lever 1 and a lock pin 2 positioned at end 45 of inner cylinder 41 and end 43 of outer cylinder 42 to lock latch bar 40 in this expanded length or unlock it to permit it to contract.

As set forth above, the framework of collapsible bracket 10 is movable between two positions a contracted position (collapsed and/or folded position) as shown in FIGS. 2 and 3 and an expanded position (un-collapsed and/or un-folded position) as shown in FIGS. 4 and 5. When in the contracted position, first and second linkages 50 and 52 are collapsed such that they are folded or collapsed in a substantially parallel position alongside (against) base 12, vertical support 30 is in the horizontal orientation which contracts latch bar 40, and first and second arms 22 and 24 are contracted (collapsed) such that they are in a substantially parallel and horizontal position aligned with and alongside base 12. In other words, first and second arms 22 and 24 are in an un-raised position such that collapsible bracket 10 is substantially flat. In this contracted position, collapsible bracket 10 has a height $H_1$ (FIG. 2) and a width $W_1$ (FIG. 3) configured to permit an emergency cot to pass (roll) over and by the collapsible bracket without any component of bracket 10 (e.g., first and second hooks 21 and 25) interfering with the cot's movement as it is being loaded onto or unloaded from an emergency vehicle.

When in the expanded position, first and second linkages 50 and 52 are expanded (un-collapsed and/or un-folded) such that they extend substantially perpendicular from base 12 (FIG. 4), vertical support 30 is in the vertical orientation (FIG. 5) which extends latch bar 40 (inner cylinder 41 and outer cylinder 42 are substantially end-to-end), and first and second arms 22 and 24 are expanded such that they are substantially extended up and away from base 12 (FIGS. 1, 4, and 5). In this expanded position, collapsible bracket 10 has a height $H_2$ (FIG. 4) and a width $W_2$ (FIG. 5) configured to permit first and second hooks 21 and 25 to engage an emergency cot after it has been loaded into an emergency vehicle to secure and/or hold the cot in a substantially stationary position within the vehicle. In other words, collapsible bracket 10 may be configured such that height $H_2$ and width $W_2$ is greater than height $H_1$ and width $W_1$.

In one exemplary embodiment shown in FIG. 6, an emergency cot 100 includes four rollers 102, one on each of the four corners of the cot, that the cot rests and rolls on. As shown, collapsible bracket 10 is configured such that when it is in the contracted position, its width $W_1$ is less than the width $w_1$ of rollers 102 in order to permit the cot to roll by the respective first and second hooks 21 and 25 and its height $H_1$ is low enough to allow the cot to roll over collapsible bracket 10 without interfering with the cot's movement as it is being loaded onto or unloaded from an emergency vehicle.

An exemplary collapsible bracket may be configured such that it has a width $W_1$ equal to from about 1 inches (about 2.54 centimeters) to about 20 inches (about 50.8 centimeters), more particularly from about 5 inches (about 12.7 centimeters) to about 15 inches (about 38.1 centimeters) and a height $H_1$ equal to from about 0.1 inches (about 0.254 centimeter) to about 12 inches (about 30.48 centimeters), more particularly from about 1.0 inches (about 2.54 centimeters) to about 5 inches (about 12.7 centimeters), and a $W_2$ from about 15 inches (about 38.1 centimeters) to about 30 inches (about 76.2 centimeters), more particularly from about 18 inches (about 45.72 centimeters) to about 25 inches (about 63.5 centimeters) and a height $H_2$ from about 3 inches (about 7.62 centimeters) to about 10 inches (about 25.4 centimeters), more particularly from about 4 inches (about 10.16 centimeters) to about 8 inches (about 20.32 centimeters). Another exemplary collapsible bracket may be configured such that it has a width $W_1$ equal to about 13.5 inches (about 34.29 centimeters) or less and a height $H_1$ equal to about 2.5 inches (about 6.35 centimeters) or less, and a $W_2$ greater than or equal to about 20 inches (about 50.8 centimeters) and a height $H_2$ greater than or equal to about 6 inches (about 15.24 centimeters). In addition, collapsible bracket 10 is configured such that when it is in the expanded position, its width $W_2$ is greater than the width $w_1$ of rollers 102 and its height $H_2$ is such that first and second hooks 21 and 25 engage respective rollers 102 in order to hold and/or secure cot 100 in a substantially stationary position within the emergency vehicle. For example, collapsible bracket 10, when in the expanded position, may prevent cot 100 from substantial and/or no movement (e.g., rolling around) within the emergency vehicle. Such a collapsible bracket permits the use of multiple brackets to secure multiple emergency cots that are loaded into an emergency vehicle with very little effort required to secure each cot.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A bracket for an emergency vehicle, comprising:

a base for mounting to an the emergency vehicle; and a framework connected to the base and movable between a contracted position and an expanded position, wherein:

the contracted position has a first height and a first width;

the expanded position has a second height and a second width;

the second height is greater than the first height;

the second width is greater than the first width;

the framework engages an emergency cot within an the emergency vehicle when in the expanded position.

2. The bracket according to claim 1, wherein the framework does not engage the emergency cot within the emergency vehicle when in the contracted position.

3. The bracket according to claim 1, wherein the first height and first width is such that the emergency cot may pass over and by the framework without the framework engaging the emergency cot, and wherein the second height and second width is such that the framework engages the emergency cot within the emergency vehicle.

4. The bracket according to claim 1, wherein when in the expanded position, the framework engages the emergency cot such that the emergency cot remains substantially stationary within the emergency vehicle.

5. The bracket according to claim 1, wherein the framework is movably connected to the base using a joint.

6. The bracket according to claim 1, wherein the framework comprises first and second arms for engaging respective sides of the emergency cot when the framework is in the expanded position.

7. The bracket according to claim 6, wherein the first and second arms comprise respective first and second hooks for engaging rollers of the emergency cot and securing the emergency cot within the emergency vehicle.

8. The bracket according to claim 6, wherein the framework comprises a vertical support having a first support end and a second support end, wherein the first support end is movably connected to the base and the second support end is movably connected to the first and second arms.

9. The bracket according to claim 8, wherein the base comprises a first base end and a second base end;

the framework comprises a latch bar that is movably connected to the first base end and the second support end; and the latch bar contracting when the framework is in the contracted position and expands when the framework is in the expanded position.

10. A bracket for an emergency vehicle, comprising:

a base for mounting to the emergency vehicle;

a first engagement device movably connected to the base and movable between a first position wherein the first engagement device does not engage an emergency cot within the emergency vehicle and a second position wherein the first engagement device does engage the emergency cot within in the emergency vehicle; and a second engagement device movably connected to the base opposite the first engagement device and movable between the first position that positions the second engagement device such that the second engagement device does not engage the emergency cot within the emergency vehicle and the second position that positions the second engagement device such that the second engagement device does engage the emergency cot within in the emergency vehicle.

wherein the first and second engagement devices comprise respective first and second hooks, and wherein the first and second hooks engage opposite rollers of the emergency cot within the emergency vehicle when the first and second engagement devices are in the second position.

11. The bracket according to claim 10, wherein the first position of the first engagement device and the second engagement device has a first height and first width and the second position of the first engagement device and the second engagement device has a second height and second width, and wherein the second height and second width are greater than the first height and first width.

12. The bracket according to claim 11, wherein the first height and first width is such that the emergency cot may pass over and by the first and second engagement devices and the base without the first and second engagement devices and the base engaging the emergency cot, and wherein the second height and second width is such that the first and second engagement devices and the base engages the emergency cot within the emergency vehicle.

13. The bracket according to claim 10, wherein when in the second position, the first and second engagement devices engage the emergency cot such that the emergency cot remains substantially stationary within the emergency vehicle.

14. A bracket for an emergency vehicle, comprising:

a base for mounting to the emergency vehicle;

a first arm connected to the base and movable between a first position and a second position; and a second arm connected to the base opposite the first arm and movable between a first position and a second position;

wherein the first positions dispose first and second arms such that the first and second arms do not engage an emergency cot within the emergency vehicle, and wherein the second positions dispose the first and second arms such that the first and second arms do engage the emergency cot within the emergency vehicle;

wherein the first position positions the first and second arms such that the first and second arms have a first height and a first width;

wherein the second position positions the first and second arms such that the first and second arms have a second height and a second width, wherein the second height is greater than the first height, and wherein the second width is greater than the first width.

15. The bracket according to claim 14, wherein the first and second arms prevent the emergency cot from moving within the emergency vehicle when in the second position.

16. The bracket according to claim 14, further comprising a lever connected to the first and second arms enabling the first and second arms to be locked in a stationary position.

17. The bracket according to claim 10, wherein:

when in the first position, the first and second engagement devices define a first height and a first width;

when in the second position, the first and second engagement devices define a second height and a second width;

the second height is greater than the first height; and the second width is greater than the first width.

* * * * *

UNITED STATES PATENT AND TRADEMARK OFFICE

CERTIFICATE OF CORRECTION

PATENT NO. : 8,419,100 B2
APPLICATION NO. : 12/377484
DATED : April 16, 2013
INVENTOR(S) : Bob Chinn It is certified that error appears in the above-identified patent and that said Letters Patent is hereby corrected as shown below:

In the Specifications

Col. 1, Line 33, “cot within in an” should read --cot within an--;

Col. 2, Line 35, “position” should read --position.--;

In the Claims

Col. 5, Claim 1, Line 16, “to an the emergency” should read --to an emergency--;

Col. 5, Claim 1, Lines 24-25, “within in the emergency” should read --within an emergency--;

Col. 6, Claim 10, Line 11, “emergency vehicle.” should read --emergency vehicle;--.

Signed and Sealed this
Third Day of December, 2013

Margaret A. Focarino

Margaret A. Focarino
*Commissioner for Patents of the United States Patent and Trademark Office*